US005152736A

United States Patent [19]

Owen et al.

[11] Patent Number: 5,152,736

[45] Date of Patent: Oct. 6, 1992

[54] CONCAVE SHAPED CONTAINER BOTTOM END CLOSURE AND METHOD OF FORMING SAME

[75] Inventors: Barry C. Owen, Southfield; Frank D. Risko; Gregory J. Dwyer, both of Livonia, all of Mich.

[73] Assignee: Elopak Systems A.G., Glattbrugg, Switzerland

[21] Appl. No.: 783,261

[22] Filed: Oct. 28, 1991

[51] Int. Cl.[5] ..... B31B 3/25; B31B 3/26

[52] U.S. Cl. ..... 493/133; 493/160

[58] Field of Search ..... 493/133, 160, 164, 183, 493/902

[56] References Cited

U.S. PATENT DOCUMENTS

| | | | |
|---|---|---|---|
| 3,303,761 | 2/1967 | Monroe et al. | 493/183 |
| 4,669,253 | 6/1987 | Shavit | 53/455 |
| 4,795,086 | 1/1989 | Farber | 493/160 |
| 4,838,747 | 6/1989 | Kume et al. | 493/133 |

*Primary Examiner*—William E. Terrell

*Attorney, Agent, or Firm*—John P. Moran

[57] ABSTRACT

A bottom end closure for a liquid-carrying paperboard container, wherein particular diagonal and sloped score lines are formed on the inner closure panels by modified sealing jaws, such that, upon being engaged by the sealing jaws, the score lines enhance the formation of a concave shape to the bottom end closure. The result is that the filled container will sit flat and stand erect, without any interfering downward bulging.

4 Claims, 4 Drawing Sheets

CONCAVE SHAPED CONTAINER BOTTOM END CLOSURE AND METHOD OF FORMING SAME

TECHNICAL FIELD

This invention relates generally to forming, filling and sealing machines for thermoplastic-coated liquid containers and, more particularly, to an improved bottom end closure for such containers, and to the mechanism for forming same.

BACKGROUND ART

Typically, the above referenced forming, filling and sealing machines are adapted to receive flat blanks, open same into a tube, form and seal one end of the tube, fill the container with the desired liquid, and form and seal the other end.

The thus formed bottom end of the container, while generally flat, tends to bulge downwardly once the container is filled due to the flexibility of the paperboard and, hence, may not stand directly upright during storage and shipping.

Kume et al U.S. Pat. No. 4,838,847 discloses a container which is recessed in the central portion of its bottom so as to seat stably. The recessed bottom is formed first on a mandrel whose end surface defines a pyramidal-shaped cavity for cooperation with a projection complementary to the cavity formed on the face of a press member serving to form the recess on the container bottom therebetween when sealed under pressure.

DISCLOSURE OF THE INVENTION

A general object of the invention is to provide an improved thermoplastic-coated paperboard container with a concave-shaped bottom end closure which will sit flat and stand erect after being filled.

Another object of the invention is to provide a thermoplastic-coated paperboard container having score line modifications formed on the blank which permit the bottom end closure thereof to be formed with the concave shape.

A further object of the invention is to provide a container having both diagonal and sloped score lines formed on each of the inner bottom closure panels, in addition to the usual diagonal score lines formed on each of the outer bottom closure panels, to facilitate producing a concave shape on the bottom end closure, so that the container will stand directly upright.

Still another object of the invention is to provide an improved folding and forming mechanism on a forming, filling and sealing machine which serves to form a concave-shaped bottom end closure on a thermoplastic-coated paperboard container being processed thereon.

A still further object of the invention is to provide such mechanism on the machine in conjunction with the forming and sealing jaws after the container has been filled.

A still further object of the invention is to provide such forming and sealing jaws which apply force to the center of the container end closure after the underside of the bottom container sealed fin has been heated, to thereby prevent a sliding action or movement at the center of the fin seal.

These and other objects and advantages of the invention will be more apparent when reference is made to the following drawings and the accompanying description.

BEST MODE OF CARRYING OUT THE INVENTION

Figure 1:
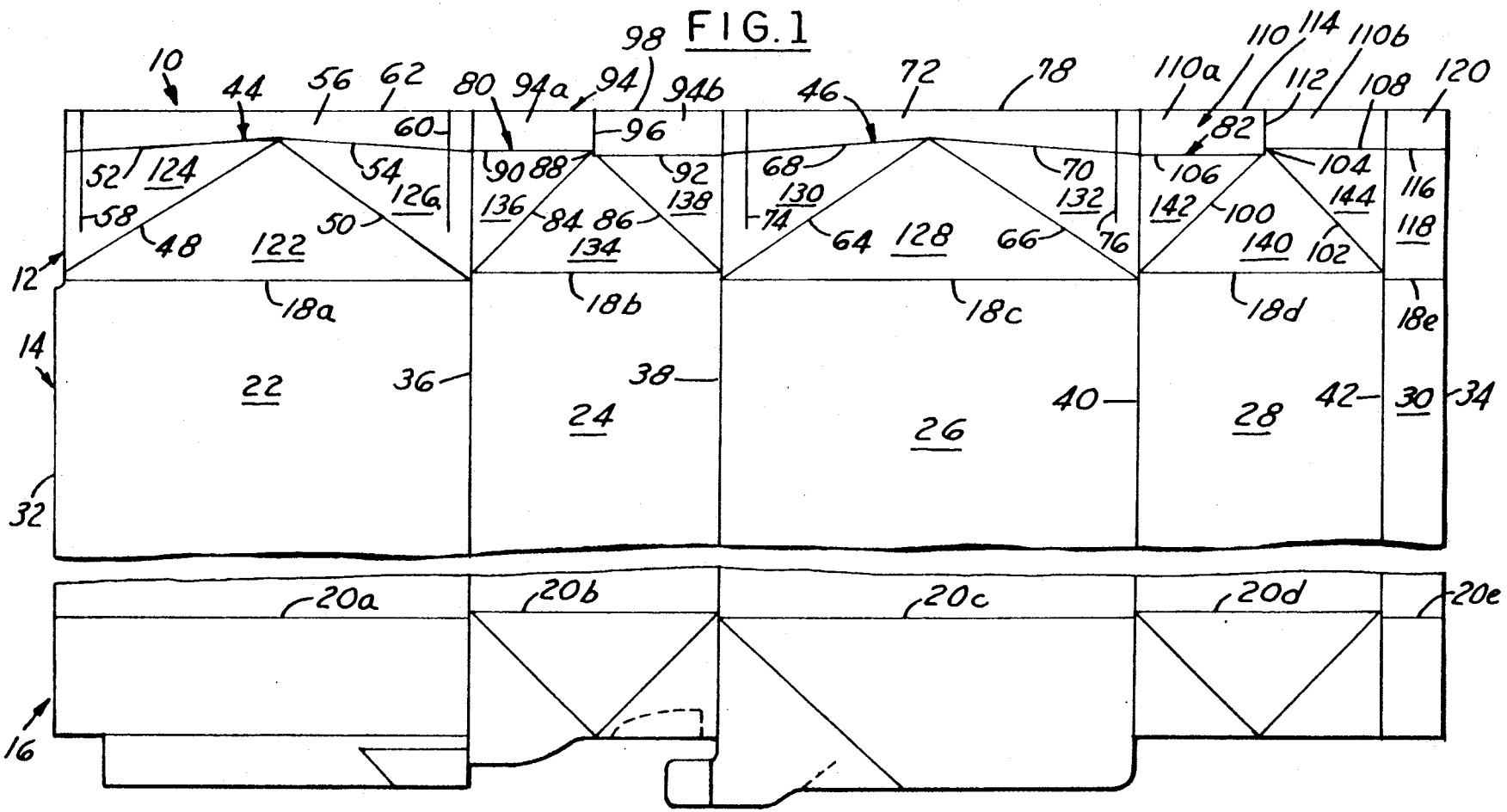
FIG. 1 is a layout view of the inside surface of a thermoplastic-coated paperboard container blank used to construct a container having a bottom end closure in accordance with the present invention.

Referring now to the drawings in greater detail, FIG. 1 illustrates a container blank 10 formed in accordance with the principles of the present invention. The container blank 10 is generally divided into three sections including a first end closure 12, a body portion 14, and a second end closure 16. A first staggered horizontal score line 18*a*, 18*b*, 18*c*, 18*d*, and 18*e* extends transversely across the container blank 10 and separates the first end closure 12 and the body portion 14. A second staggered horizontal score line 20*a*, 20*b*, 20*c*, 20*d*, and 20*e* extends transversely across the container blank 10 and separates the body portion 14 and the second end closure 16.

The body portion 14 comprises a plurality of integrally connected body panels, namely, a first panel 22, a second panel 24, a third panel 26, a fourth panel 28, and a side seam flap or narrow fifth panel 30 formed adjacent the fourth panel 28. The blank 10 is defined on its longitudinal sides by its free edges 32 and 34. The body panels 22, 24, 26 and 28, and the side seam flap are defined by vertical score lines 36, 38, 40 and 42.

The end closure 12 has a pair of inner closure panels 44 and 46 which are integral with and extend longitudinally from the body panels 22 and 26, respectively.

A pair of diagonal score lines 48 and 50 formed on the panel 44 form a triangle with the horizontal score line 18*a*. The diagonal score lines 48 and 50 extend from the side free edge 32 and the vertical score line 36, respectively. A pair of sloped score lines 52 and 54 extend upwardly from the side free edge 32 and the vertical score line 36 to the apex of the triangle formed by the diagonal score lines 48 and 50, separating the inner closure panel 44 from a sealing panel 56. Two supplemental vertical score lines 58 and 60 extend from the top free edge 62 of the sealing panel 56 adjacent the respective side edge 32 and the vertical score line 36 to points on the inner closure panel 44 spaced above the diagonal score lines 48 and 50, respectively.

The inner closure panel 46 includes score lines comparable to those formed on the panel 44. Specifically, a pair of diagonal score lines 64 and 66 on the panel 46 form a triangle with the horizontal score line 18*c*. The diagonal score lines 64 and 66 extend from the vertical score lines 38 and 40, respectively. A pair of sloped score lines 68 and 70 extend upwardly from the vertical score lines 38 and 40 to the apex of the triangle formed by the diagonal score lines 64 and 66, separating the inner closure panel 46 from a sealing panel 72. Two supplemental vertical score lines 74 and 76 extend from the top free edge 78 of the sealing panel 72 adjacent the respective vertical score lines 38 and 40 to points on the inner closure panel 46 spaced above the diagonal score lines 64 and 66, respectively.

A pair of outer closure panels 80 and 82 are an integral part of the end closure 12, and they extend longitudinally from the body panels 24 and 28, respectively.

A pair of diagonal score lines 84 and 86 are formed on the panel 80, extending from the ends of the horizontal score line 18*b*, at the vertical score lines 36 and 38, respectively, to points separated by a short vertical score line 88. Staggered horizontal score lines 90 and 92 extend from the vertical score lines 36 and 38 to the respective upper and lower ends of the short vertical score line 88, to separate the outer closure panel 80 from a sealing panel 94. A vertical score line 96 extends the short vertical score line 88 across the sealing panel 94 to the upper free edge 98 thereof, dividing the sealing panel 94 into two parts 94*a* and 94*b*.

Likewise, a pair of diagonal score lines 100 and 102 are formed on the panel 82, extending from the ends of the horizontal score line 18*d*, at the vertical score lines 40 and 42, respectively, to points separated by a short vertical score line 104. Staggered horizontal score lines 106 and 108 extend from the vertical score lines 40 and 42 to the respective lower and upper ends of the short vertical score line 104, to separate the outer closure panel 82 from a sealing panel 110. A vertical score line 112 extends the short vertical score line 104 across the sealing panel 110 to the upper free edge 114 thereof, dividing the sealing panel 110 into two parts 110*a* and 110*b*.

A horizontal score line 116 extends from the end of the score line 108 across the top closure extension panel 118 to the free edge 34, providing a sealing panel portion 120.

It is noted in FIG. 1 that the horizontal score lines 18*b* and 18*d* are stepped upwardly of the score lines 18*a*, 18*c* and 18*e*.

The respective section 12 closure panel segments are identified as follows:

Panel 122 is defined by the score lines 18*a*, 48 and 50.

Panel 124 is defined by the score lines 48 and 52 and the edge 32.

Panel 126 is defined by the score lines 50, 54 and 36.

Panel 128 is defined by the score lines 18*c*, 64 and 66.

Panel 130 is defined by the score lines 64, 68 and 38.

Panel 132 is defined by the score lines 66, 70 and 40.

Fold-out panel 134 is defined by the score lines 18*b*, 84 and 86.

Fold-in panel 136 is defined by the score lines 84, 90 and 36.

Fold-in panel 138 is defined by the score lines 86, 92 and 38.

Fold-out panel 140 is defined by the score lines 18*d*, 100 and 102.

Fold-in panel 142 is defined by the score lines 100, 106 and 40.

Fold-in panel 144 is defined by the score lines 102, 108 and 42.

The second end closure 16 can be any flat end closure arrangement, e.g., the end closure shown and described in Lisiecki U.S. Pat. No. 4,582,246, issued on Apr. 15, 1986. It is essential that the end closure 16 have a flat configuration, inasmuch as this end will be formed first on the usual forming, filling and sealing machine mandrel arrangement, prior to filling the container with a liquid. Hence, the end closure 12 will then be formed and sealed after the container has been filled. After discharge, the container will be inverted, making the end closure 16 the top end and the end closure 12 the bottom end.

Figure 2:
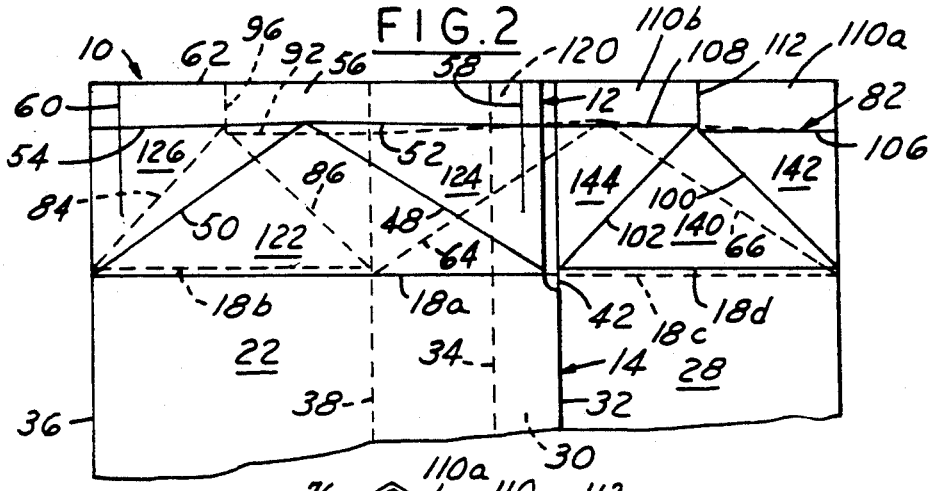
FIG. 2 is a fragmentary layout view of the outside surface of a container blank structure after it is side seamed from the container blank illustrated in FIG. 1.

The blank 10 is formed into a liquid-carrying container in the following manner:

The container blank 10 illustrated in FIG. 1 is first formed into a side seam blank as illustrated in FIG. 2. The side seam blank is formed by rotating the body panel 28 and the side seam flap 30 as a unit about the vertical score line 40, and having the inside surfaces of the body panel 28 come into contact with the inside surface of the body panel 26. The body panel 22 is then rotated about the vertical score line 36 to bring its inside surface into contact with the inside surface of the body panel 24. The inside surface of the body panel 22 along the edge 32 comes into contact with the outside surface of the side seam flap 30. The various members of the first end closure 12 and the second end closure (not shown) will make similar movements, and the container will appear as illustrated in FIG. 2. The container blank 10 is then sealed where the inside area of the body panel 22 comes into contact with the outside surface of the side seam flap 30.

Figure 3:
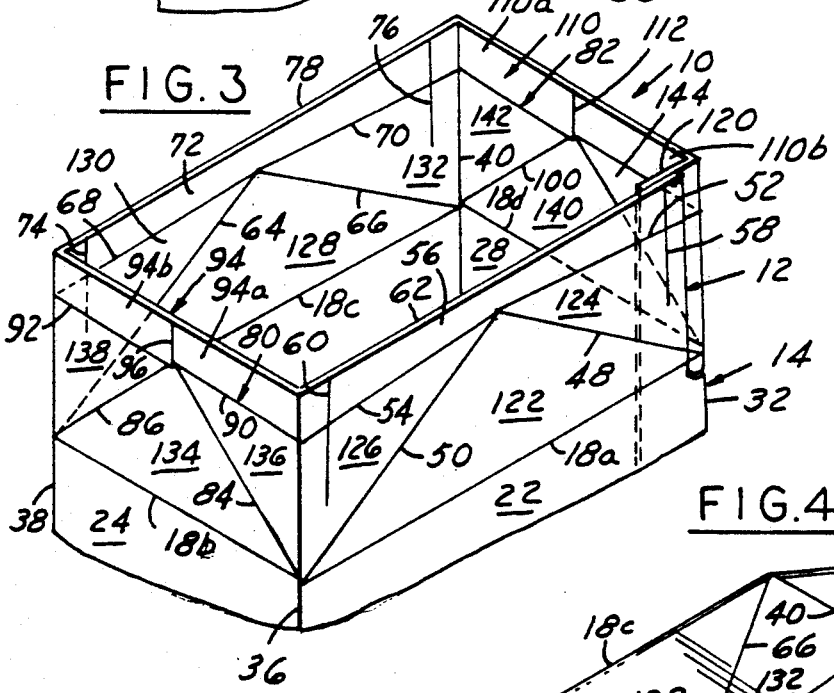
FIG. 3 is a fragmentary perspective view showing the side seamed container blank illustrated in FIG. 2 in an open ended condition prior to the closing of the end closure structure of the present invention.

The next step in forming the side seamed blank into a container is illustrated in FIG. 3. FIG. 3 illustrates how the side seam blank is opened up into a four-sided condition, after which the second end closure 16 is formed and sealed in a manner well known in the container art, and disclosed in detail in the prior art U.S. Pat. Nos. 4,582,246; 3,120,335; and 3,498,524.

After the second end closure is formed and a product, such as milk or juice, has been inserted in the container, the various parts of the first end closure 12 are folded about the various score lines in the following manner so as to form the closed end structure. The triangular panel 134 is moved around the horizontal score line 18*b* over the end of the filled container and away from its center. At the same time, the triangular closure panel 136 is likewise moved away from the center of the filled container about the horizontal score line 18*d*. The inside surfaces of the sealing panels 94*a* and 94*b* are rotated towards each other about the vertical score line 96; the inside surfaces of the sealing panels 110*a* and 110*b* are rotated towards each other about the vertical score line 112, and the inside surfaces of the sealing panels 56 and 72 are moved toward each other. The inside surfaces of the triangular panels 136 and 138 thereby come into contact with the triangular panel 134, and the inside surfaces of the triangular panels 142 and 144 into contact with the panel 140.

Figure 11:
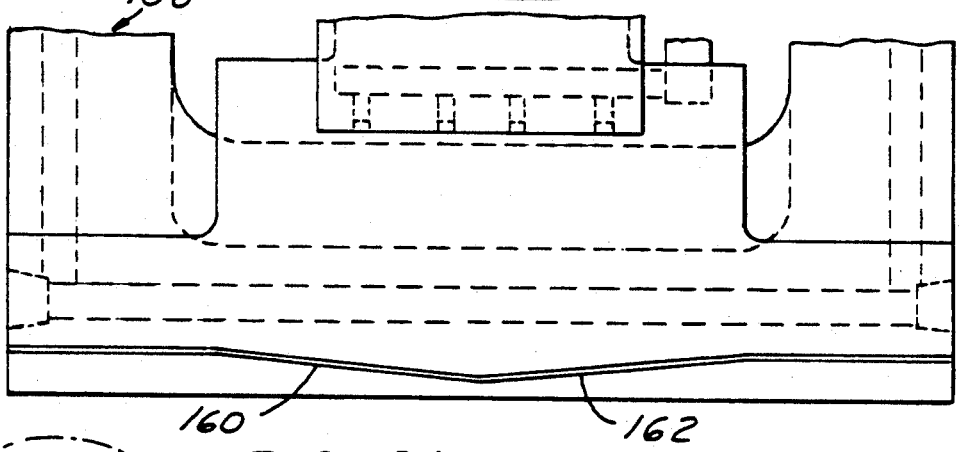
FIG. 11 is a view taken along the plane of the line 11—11 of FIG. 10, and looking in the direction of the arrows.

The sealing of the panels 94*b*, 72 and 110*a* to the panels 94*a*, 56 and 110*b*, respectively, is accomplished by conventional means, such as a sonic or high frequency vibration sealing means, such a seal providing a liquid tight seal. Separate heating and sealing of these various top end closure elements may also be accomplished by other means, such as gas or electric heat, in conjunction with separate sealing jaws. An anvil and jaw 158 provide sealing forces to the sealing panels, and have V-shaped surfaces 160 and 162 formed on the end thereof (FIG. 11).

Figure 9A:
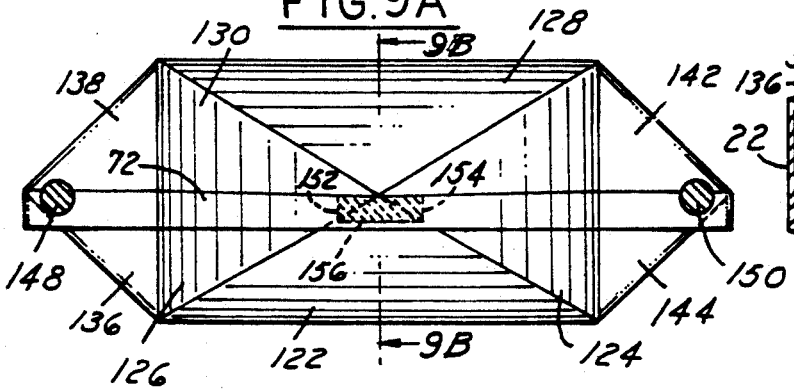
FIG. 9A is an end view of the FIG. 4 configuration just before the sealing panels are folded flat.
Figure 9B:
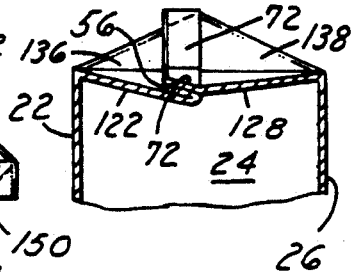
FIG. 9B is a fragmentary side view taken along the plane of the line 9B—9B, and looking in the direction of the arrows.
Figure 10:
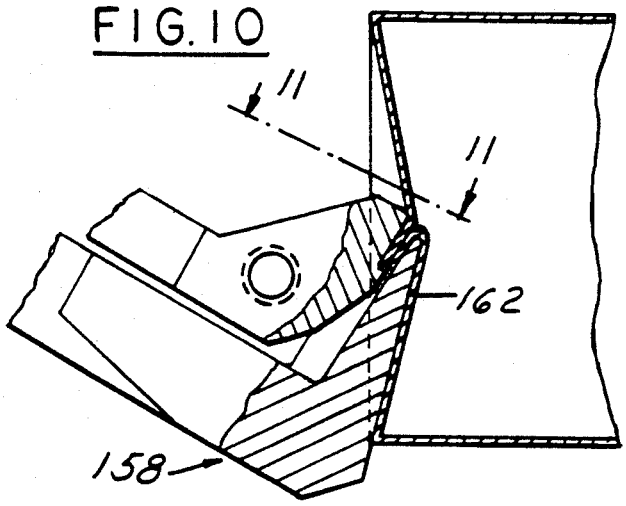
FIG. 10 is a fragmentary side elevational view of a sealer jaw operable on a container end closure.

Referring now to FIG. 9A, before the adjacent pairs of sealing panels 94*a*/94*b*, 110*b*/110*a*, and 56/72 are folded flat, heat is applied adjacent the sealing panels 94*a* and 110*b* on areas represented as 148 and 150, and to the center area of the underlying panel 72 (FIG. 9B) and adjacent area portions of the panels 128, 130 and 132, as represented by hidden lines 152, 154 and 156. The heated areas 148 and 150 and heated area defined by lines 152, 154 and 156 serve to prevent a sliding action or movement of the center of the fin seal, While the sloped score lines 52 and 54, and 68 and 70 permit the final sealing to occur in the "V" or concave shape shown in FIG. 10, such that the apices of the triangular panels 122 and 128 are adjacent one another.

Figure 12A:
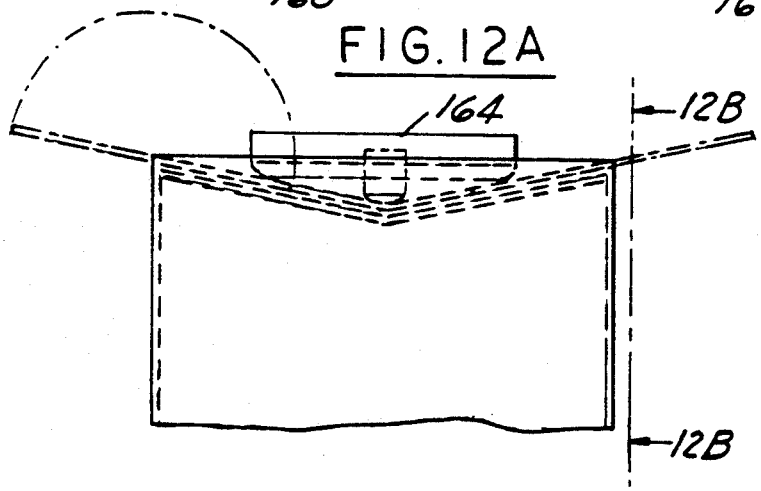
FIG. 12A is a fragmentary side view of the FIG. 5 structure, showing a machine component cooperating with the container end closure.
Figure 12B:
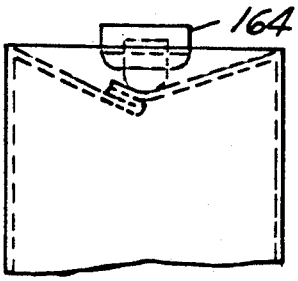
FIG. 12B is a side view taken along the plane of the line 12B—12B, and looking in the direction of the arrows.

At a next station (FIGS. 12A and 12B) a hold-down lug 164 on an overhead chain applies pressure to the concave center while the cooling thereof is completed.

Figure 4:
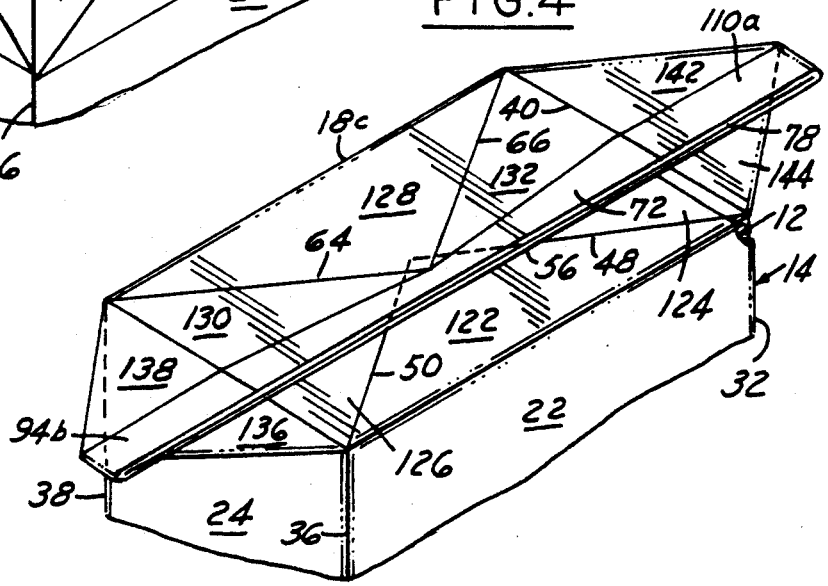
FIGS. 4 and 5 are fragmentary perspective views similar to FIG. 3, and showing the end closure evolved from the blank of FIG. 3 in partially closed conditions.
Figure 5:
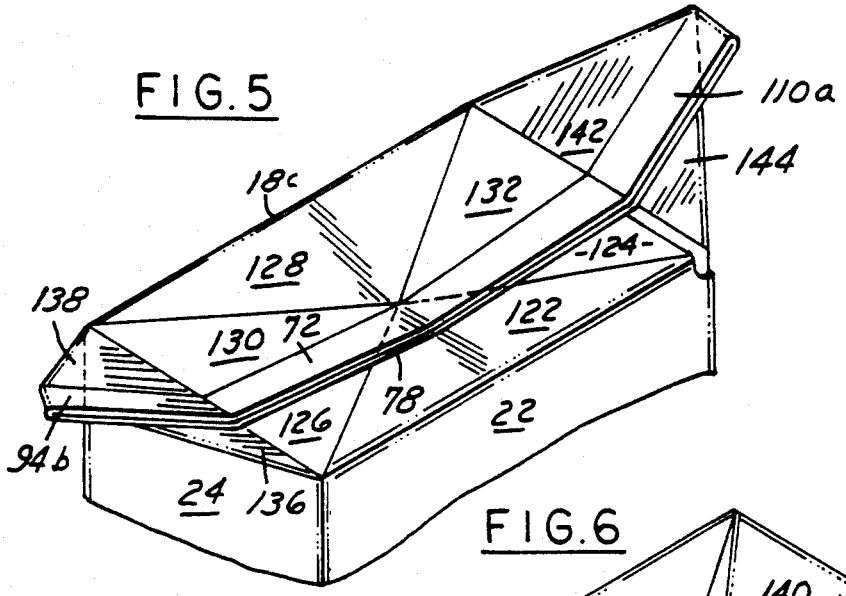

FIG. 4 illustrates the positions of the various elements of the end closure 12 once the sealing thereof has been effected and the end closure has been moved into a modified flat configuration with the 80 and 82 groups of panels extending outwardly from the side panels 24 and 28, respectively. By virtue of the offset between the horizontal score lines 90 and 92, and the score lines 108 and 106 (FIG. 3), folding toward the panels 134, 128, and 140 is enhanced, as explained in Lisiecki U.S. Pat. No. 4,394,954, issued Jul. 26, 1983. As indicated in FIG. 5, the 134/136/138 and 140/142/144 groups of panels are then both folded upwardly and inwardly with a 180° turn about their respective segments of score line 18*b* and 18*d*, into the substantially flat configuration of FIG. 6.

Figure 6:
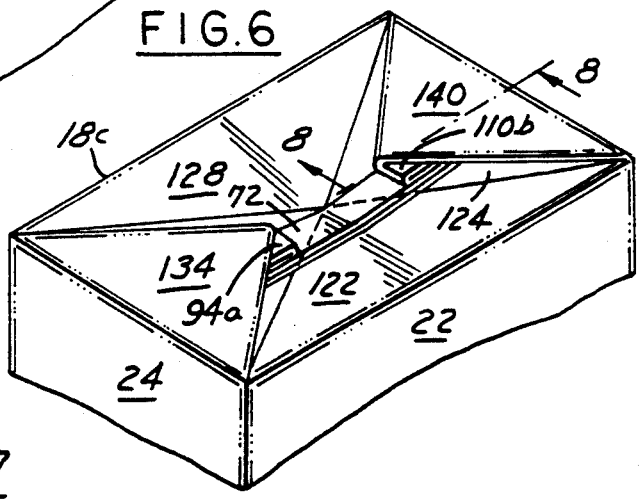
FIG. 6 is a fragmentary perspective view showing the container after the end closure has been folded and sealed into a completely closed condition.
Figure 7:
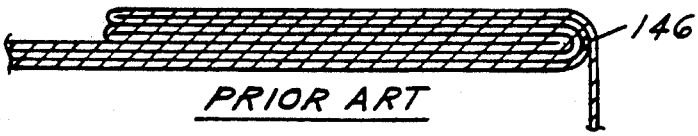
FIG. 7 is a fragmentary cross-sectional view showing a prior art container after being folded through the steps of FIGS. 4, 5 and 6.
Figure 8:
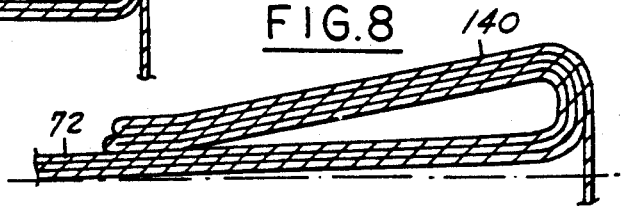
PRIOR ART FIG. 8
FIG. 8 is a fragmentary cross-sectional view taken along the plane of the line 8—8 of FIG. 6, and looking in the direction of the arrows, showing a container of the present invention after being folded through the steps of FIGS. 4, 5 and 6.

Without the inclusion of the supplemental score lines 58, 60, 74 and 76, the final folded configuration of FIG. 6 would include the seven thicknesses shown in FIG. 7, and shown and described in Lisiecki U.S. Pat. No. 4,546,915, issued on Oct. 5, 1985. Throughout such folding operations, at times the outermost 180° folded layer is stretched to the point where it becomes pulled apart, resulting in a crack, as shown at 146 in FIG. 7. Now, by including the supplementary score lines, the severity of the bends is reduced from 180° bends to respective pairs of spaced apart substantially 90° bends, as shown in FIG. 8.

INDUSTRIAL APPLICABILITY

It should be apparent that, by virtue of the modified sloped score lines 52/54 and 68/70, rather than being horizontal, in conjunction with the extended adjacent apices of the adjacent triangular panels 122 and 128 defined by the respective pairs of diagonal score lines 48/50 and 64/66, a concave bottom end closure results, bending about the various score lines 48, 50, 52 and 54, and 64, 66, 68 and 70, providing an erect, steady filled container.

It should also be apparent that the selected application of heat and the modified sealing jaw and pressure pad, cooperate with the modified score lines formed on the container blank to produce the erect, steady filled container.

While but one embodiment of the invention has been shown and described, other modifications thereof are possible within the scope of the following claims.

The embodiments of the invention in which an exclusive property or privilege is claimed are defined as follows:

1. The method of forming a concave-shaped bottom closure on a container having four body panels and a side seam flap connected to one another by respective vertical score lines, a first flat end closure, wherein the second end closure includes two oppositely disposed inner closure panels and two oppositely disposed outer closure panels connected to the four body panels by respective horizontal score lines, the outer closure panels each including a central fold-out panel and a fold-in panel on each side thereof folded onto the inner surface of the central fold-out panel and sealed thereto, and sealing panels external of each fold-in panel and external of the inner closure panels and having their respective inner surfaces sealed together;

said method comprising:

a. forming two converging diagonal score lines on each of said inner closure panels from oppositely disposed vertical score lines forming a central triangular panel with the respective intermediate horizontal score line;

b. forming two upwardly sloping score lines on each of said inner closure panels from said oppositely disposed vertical score lines to the apex of said triangle forming left and right triangular panels flanking said central triangular panel;

c. forming a V-shape on the end of a forming jaw; and d. pressing said V-shaped surface of said forming jaw against said inner closure panels to force same inward with respect to the adjacent ends of the four body panels and cause said central triangular panel and said left and right triangular to bend about the respective diagonal converging score lines and upwardly sloping score lines to form the concave-shaped bottom closure.

2. The method described in claim 1, and a step of applying heat to on side of the sealed together sealing panels external of the inner closure panels at the center thereof, and folding same heated side down onto one of the inner closure panels.

3. The method described in claim 2, and a step of applying heat to the sealed together sealing panels external of each fold-in panel adjacent the ends thereof on the side thereof opposite said one side of the other heated sealing panels.

4. The method described in claim 3, and a step of folding each combination of central fold-out panel, fold-in panel on each side thereof, and adjacent heated pair of sealing panels onto said folded over pair of sealing panels external of the inner closure panels.

* * * * *